US006268693B1

(12) United States Patent
Miwa et al.

(10) Patent No.: US 6,268,693 B1
(45) Date of Patent: Jul. 31, 2001

(54) CATHODE RAY TUBE HAVING A REDUCED DIFFERENCE IN LIGHT TRANSMITTANCES BETWEEN A CENTRAL REGION AND A PERIPHERAL REGION OF A PANEL FACE THEREOF

(75) Inventors: Yoshiharu Miwa, Ohmihachiman; Tsutomu Imamura, Sakata-gun, both of (JP)

(73) Assignee: Nippon Electric Glass Co., Ltd., Otsu (JP)

( * ) Notice: Subject to any disclaimer, the term of this patent is extended or adjusted under 35 U.S.C. 154(b) by 0 days.

(21) Appl. No.: 09/405,538

(22) Filed: Sep. 24, 1999

(30) Foreign Application Priority Data

Mar. 26, 1998 (JP) ..... 100163
Mar. 26, 1998 (JP) ..... 100164

(51) Int. Cl.[7] ..... H01J 29/06; H01J 29/88

(52) U.S. Cl. ..... 313/479; 313/112; 348/835; 359/614

(58) Field of Search ..... 313/479, 112; 348/834, 835; 359/609, 614, 885, 308

(56) References Cited

U.S. PATENT DOCUMENTS 5,189,337 * 2/1993 Endo et al. ..... 313/479
5,404,073 * 4/1995 Tong et al. ..... 348/834 X
5,717,282 * 2/1998 Oomen et al. ..... 313/479
5,760,540 * 6/1998 Duistermaat ..... 313/479 X

FOREIGN PATENT DOCUMENTS

0095568 * 8/1978 (JP) ..... 313/479

* cited by examiner

*Primary Examiner*—Ashok Patel
(74) *Attorney, Agent, or Firm*—Collard & Roe, P.C.

(57) ABSTRACT

In a cathode ray tube us a glass panel having a difference in thickness between a central region and a peripheral region of a face portion, the glass panel having an outer surface with a colored film formed thereon, the colored film being thin in film thickness in an area corresponding to a thick part of the face portion of the glass panel and thick in film thickness in an area corresponding to a thin part of the face portion of the glass panel so as to reduce the difference in transmittance resulting from the difference in thickness between the central region and the peripheral region of the face portion of the glass panel. As another embodiment, the colored film comprises a film having a light color tone in an area corresponding to a thick part of the face portion of the glass panel and a dark color tone in an area corresponding to a thin part of the face portion of the glass panel.

8 Claims, 2 Drawing Sheets

CATHODE RAY TUBE HAVING A REDUCED DIFFERENCE IN LIGHT TRANSMITTANCES BETWEEN A CENTRAL REGION AND A PERIPHERAL REGION OF A PANEL FACE THEREOF

BACKGROUND OF THE INVENTION

This invention relates to a cathode ray tube for use in a television receiver, a display for a personal computer, and the like.

Referring to FIG. 1, a cathode ray tube comprises as an envelope a glass bulb which includes a glass panel 11 with a fluorescent film 10 formed on an inner surface thereof, a flare-shaped funnel 12 formed behind the glass panel 11, and a neck 13 with an electron gun arranged therein, as well known in the prior art. In the inner surface of the glass panel, a shadow mask 14 is arranged to face the fluorescent film 10. An electron beam emitted from the electron gun is irradiated through the shadow mask 14 onto the fluorescent film 10 so that an image is displayed on a front portion (hereinafter referred to as a face portion) of the glass panel 11.

The interior of the above-mentioned cathode ray tube is kept in a high vacuum state so that the glass bulb is subjected to compressive stress and tensile stress. If mechanical shock is applied to the glass bulb, there is a risk of occurrence of implosion. In view of the above, the face portion of the glass panel generally has a thickness greater in its peripheral region than in its central region, for the purpose of maintaining the sufficient strength of the cathode ray tube.

Accordingly, the typical glass panel is liable to have a difference in light transmittance between a central region and a peripheral region of the face portion. As a result, the luminance in the peripheral region is reduced in comparison with the central region so that the image becomes nonuniform in brightness and is therefore hard to watch.

In addition, various kinds of glasses are used for the glass panel in dependence upon applications thereof. As the transmittance of the glass itself forming the glass panel is higher, the difference in transmittance resulting from the difference in thickness between the central region and the peripheral region of the face portion becomes smaller but the contrast is decreased.

From the above-mentioned background, a proposal is made of a cathode ray tube which has a reduced difference in transmittance between the central region and the peripheral region thereof by using a glass panel made of a glass having a high transmittance, and which has an improved contrast by bonding a colored glass plate to a face portion with an adhesive.

In recent years, the glass panel is required to have a flatness. Accordingly, it is tried to increase the radius of curvature of the face portion in a diagonal direction of the outer surface thereof to 10000 mm or more. However, the greater the radius of curvature of the face portion of the glass panel is, the higher the risk of the implosion becomes. Therefore, in case where the radius of curvature of the face portion of the glass panel in the diagonal direction of the outer surface thereof is equal to 10000 mm or more as described above, the face portion is designed so that the thickness (TE) of the peripheral region in the diagonal direction and the thickness ($T_0$) of the central region satisfy the formula of $1.2 \leqq TE/T_0 \leqq 4.0$.

However, when the difference in thickness of the face portion of the glass panel is too great between the central region and the peripheral region as described above, it is difficult to sufficiently reduce the difference in transmittance between the central region and the peripheral region even if the glass panel is made of the glass having a high transmittance.

Furthermore, the greater the thickness of the face portion of the glass panel is, the heavier the cathode ray tube becomes. The use of the colored glass plate adhered to the front surface thereof further increases the weight of the cathode ray tube. As a result, transportation is difficult.

In addition, when the colored glass plate is adhered, bubbles may be mixed in the adhesive or striae may be produced so that the image is difficult to watch. Furthermore, the adhesive may be deteriorated during the use over a long period of time so that the colored glass plate is detached.

SUMMARY OF THE INVENTION

Taking the above-mentioned circumstances into consideration, it is an object of this invention to provide a cathode ray tube which has a reduced difference in transmittance between a central region and a peripheral region of a panel and a high contrast even if a glass panel has a great difference in thickness between a central region and a peripheral region of a face portion thereof.

According to this invention, there is provided a cathode ray tube using a glass panel having a difference in thickness between a central region and a peripheral region of a face portion thereof, the glass panel having an outer surface with a colored film formed thereon, the colored film being thin in film thickness in an area corresponding to a thick part of the face portion of the glass panel and thick in film thickness in an area corresponding to a thin part of the face portion of the glass panel so as to reduce the difference in transmittance resulting from the difference in thickness between the central region and the peripheral region of the face portion of the glass panel.

According to another aspect of this invention, there is provided a cathode ray tube using a glass panel having a difference in thickness between a central region and a peripheral region of a face portion thereof, the glass panel having an outer surface with a colored film formed thereon, the colored film having a light color tone in an area corresponding to a thick part of the face portion of the glass panel and a dark color tone in an area corresponding to a thin part of the face portion of the glass panel so as to reduce the difference in transmittance resulting from the difference in thickness between the central region and the peripheral region of the face portion of the glass panel.

In addition, this invention is characterized in that the radius of curvature of the face portion of the glass panel in a diagonal direction of the outer surface thereof is equal to 10000 mm or more, that the formula of $1.2 \leqq TE/T_0 \leqq 4.0$ is satisfied where TE and $T_0$ represent the thickness of the peripheral region of the face portion of the glass panel in the diagonal direction and the thickness of the central region, respectively, and that the glass panel with the colored film formed on the outer surface has a difference in transmittance less than 5% between the central region and the peripheral region of the face portion thereof.

In the cathode ray tube of this invention, the transparent colored film formed on the outer surface of the glass panel is thin in film thickness or light in color tone in the area corresponding to the thick part of the face portion of the glass panel and is thick in film thickness or dark in color tone in the area corresponding to the thin part of the face portion of the glass panel. Therefore, the reduction in luminance which has occurred only at the peripheral region of the face portion is avoided and the difference in transmittance between the central region and the peripheral region of the face portion is reduced (becomes small). It is therefore possible to approximate the transmittances of these regions to each other. The contrast is also improved by the colored film.

In case where the radius of curvature of the face portion of the glass panel in the diagonal direction of the outer surface thereof is selected 10000 mm or more, it is possible to suppress the difference in transmittance between the central region and the peripheral region of the face portion after the film is formed to a value within less than 5%, even if $TE/T_0$ is not smaller than 1.2 where TE and $T_0$ represent the thickness of the peripheral region of the face portion of the glass panel in the diagonal direction and the thickness of the central region, respectively, taking into consideration implosion-proof. Thus, it is possible to substantially completely suppress nonuniformity in brightness of the image. However, $TE/T_0$ greater than 4.0 is unfavorable because the weight of the cathode ray tube is excessively increased.

In order to approximate the transmittances of the central region and the peripheral region of the face portion of the glass panel to each other, it is desired to prepare the glass panel from a glass having a high light transmittance (glass having a light transmittance not smaller than 70% at a wavelength of 550 nm as calculated for the thickness of 10.16 mm).

However, when the glass panel is prepared from the glass having a high light transmittance, the face portion has a high rear reflection. Accordingly, the problem of a double image is readily caused to occur. In the sense of preventing the above-mentioned problem, it is desirable to use the glass panel having a low light transmittance.

In this invention, the difference in transmittance between the central region and the peripheral region of the face portion is reduced by the use of the colored film. It is therefore possible to sufficiently reduce the difference in luminance between the central region and the peripheral region of the face portion, even if the glass panel prepared from the glass having a light transmittance of 70% or less is used.

In this invention, ordinary thin-film forming means can be used as a method of forming the colored film on the outer surface of the glass panel. For example, use may be made of spin coating, spray coating, sputtering, vacuum deposition, CVD, or dip coating.

Particularly, in case where the film thickness of the colored film is changed between the central region and the peripheral region of the face portion, the spin coating or the sputtering is preferably used.

Specifically, the glass panel different in thickness between the central region and the peripheral region of the face portion is prepared and the colored film is formed by applying a color coating liquid onto the outer surface thereof by the spin coating. At this time, the color coating liquid is applied onto the outer surface of the glass panel while the glass panel is rotated and heated so that the temperature of the thin part of the face portion thereof becomes higher than that of the thick part. According to this method, the higher is the part of the glass panel in temperature, the greater is the film forming speed. Accordingly, it is possible to form the colored film in the manner such that the thickness of the colored film is thin in the area corresponding to the thick part of the face portion of the glass panel and that the thickness of the colored film is thick in the area corresponding to the thin part of the face portion of the glass panel. In other words, from the thick part to the thin part of the face portion of the glass panel, the film thickness of the colored film formed thereon becomes gradually thicker.

Alternatively, the glass panel different in thickness between the central region and the peripheral region of the face portion is prepared and the colored film is formed on the outer surface thereof by the sputtering. In this case, a shielding plate (for example, a meshed shielding plate having different mesh sizes in different portions) for adjusting the amount of deposition of a sputtering material is arranged around the face portion of the glass panel and the colored film is formed by a sputtering deposition device. According to this method, the colored film is obtained in which the thickness of the colored film is thin in the area corresponding to the thick part of the face portion and the thickness of the colored film is thick in the area corresponding to the thin part of the face portion of the glass panel.

By the use of the spray coating, it is easy to change the color tone of the colored film between the central region and the peripheral region of the face portion.

Specifically, when the color coating liquid is applied by the spray coating onto the outer surface of the glass panel different in thickness between the central region and the peripheral region of the face portion, the color coating liquid having a light color tone is applied by spray-coating to the thick part of the face portion of the glass panel. On the other hand, the color coating liquid having a dark color tone is applied by spray-coating to the thin part of the face portion of the glass panel. As a result, it is possible to form the colored film which has the light color tone in the area corresponding to the thick part of the face portion of the glass panel and the dark color tone in the area corresponding to the thin part of the face portion of the glass panel.

If the spin coating or the sputtering is used as described above, the colored film having a desired film thickness can be formed by coating on the outer surface of the face portion of the glass panel at a low cost and with excellent working efficiency.

Furthermore, the use of the spray coating is advantageous in that the color tone of the colored film, the degree of light and dark, the coating amount, and the coating area can readily be selected appropriately, and that the film thickness can be controlled uniformly over the entire surface.

The above-mentioned film-forming operation can be carried out upon the face portion of the panel after the cathode ray tube is assembled by sealing the funnel and the glass panel together.

Of course, the operation can be carried out upon the glass panel before sealing the funnel and the glass panel together. In this case, however, it is required to select a film material which is not deteriorated by heat treatment in the subsequent sealing step or the like.

As a material of the colored film of this invention, use may be made of any material as far as the transmittance of the glass panel is reduced and a desired film thickness is obtained by the above-mentioned depositing method. The colored film may be a functional film, such as a conductive film or an antireflection film.

In case of the spin coating, use may be made of metal particles such as Au, Ag, Pt, Pd, Rh, Cu, Fe, Ni, Co, Sn, In, Ru, Ti, Al, and Ta, and compounds containing these metals, or organic pigments.

In case of the sputtering, use may be made of TiN, $Ti_2O_3$, $Nd_2O_3$, NiO, and the like.

In case of the spray coating, use may be made of a silica-spray liquid or a color spray liquid containing metal particles or organic pigments.

The thickness of the colored film is different depending on a film material used therefor or a configuration of the panel glass. In case where the film thickness is changed between the central region and the peripheral region of the face portion, the film thickness of the face portion is preferably between 50 and 10000 Å in the central region and between 1 and 5000 Å in the peripheral region.

DESCRIPTION OF PREFERRED EMBODIMENTS

Now, description will be made in detail about this invention with reference to embodiments and a comparative example.

(Embodiment 1)

Figure 1:
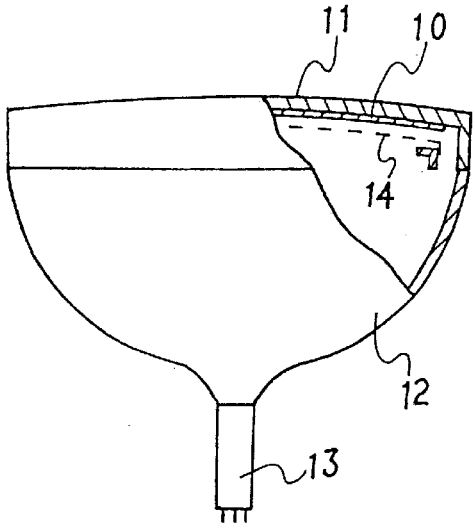
FIG.1 PRIOR ART
FIG. 1 is a partially sectional schematic view for describing the structure of a conventional typical cathode ray tube.
Figure 2:
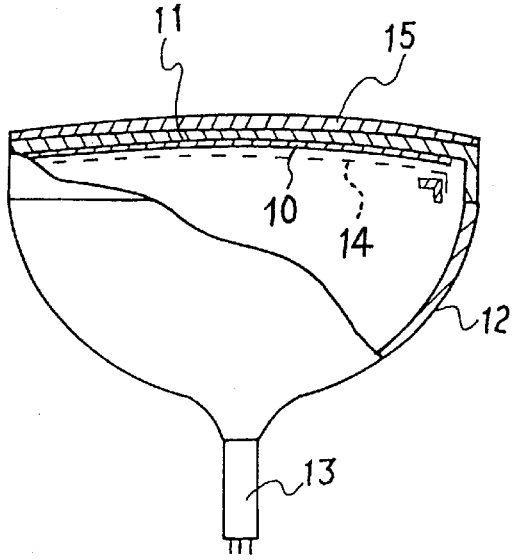
FIG. 2 is a partially sectional schematic view for describing the structure of a cathode ray tube according to an embodiment of this invention.

Referring to FIG. 2, a cathode ray tube (21 inch) according to an embodiment of this invention has a structure similar to that of the prior art. Specifically, within a glass bulb having a glass panel 11, a funnel 12, and a neck 13 sealed therein, a fluorescent film 10, a shadow mask 14, and an electron gun are arranged in the manner similar to the prior art.

The glass panel 11 of the cathode ray tube has a face portion in which the thickness ($T_0$) of a central region and the thickness (TE) of the peripheral region in a diagonal direction thereof are equal to 10 mm and 20 mm, respectively. The radius of curvature in the diagonal direction of an outer surface of the face portion is equal to 100000 mm. The transmittance of the central region of the face portion is equal to 80% and the transmittance of the peripheral region is equal to 70%.

A colored film 15 made of silver-palladium having a conductivity is formed on the outer surface of the face portion of the glass panel 11. The film thickness of the colored film 15 is equal to 500 Å in the central region and is gradually reduced toward the peripheral region. The film thickness of the peripheral region is equal to 300 Å.

The colored film on the outer surface of the face portion of the glass panel 11 was formed in the following manner.

First, the glass panel 11 was set in a spin coating device so that the outer surface thereof faces upward. Thereafter, in the state where the glass panel 11 was heated by a heater so that the peripheral region of the face portion is kept at a temperature of about 40° C. and the central region is kept at a temperature of about 50° C., the glass panel 11 was rotated at a speed of 100 rpm and a predetermined amount of a silver-palladium color coating liquid (the solid content being 0.2%) was dropped from a position above an approximate center of the face portion. Thus, the colored film 15 was formed by coating on the entire area of the outer surface of the face portion of the glass panel 11.

Measurement was made of the transmittance of the glass panel 11 with the colored film thus obtained. As a result, both of the central region and the peripheral region of the face portion had a transmittance of 56%. The cathode ray tube was produced by the use of the above-mentioned glass panel 11 and the image thereon was observed. As a result, nonuniformity in brightness was not observed.

(Embodiment 2)

Figure 3:
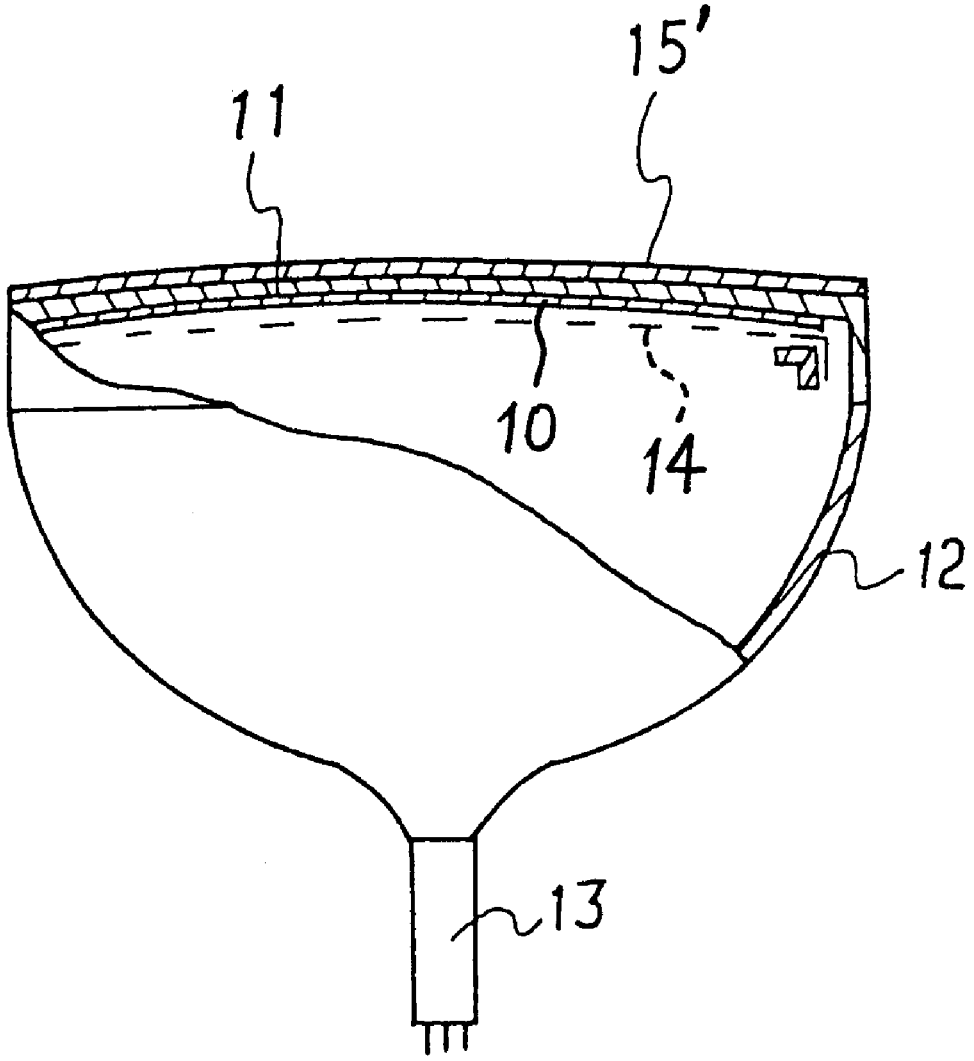
FIG. 3 is a partially sectional schematic view for describing the structure of a cathode ray tube according to another embodiment of this invention.

Referring to FIG. 3, a cathode ray tube according to a second embodiment of this invention is different from the cathode ray tube illustrated in FIG. 2 only in the colored film on the outer surface of the face portion and is similar in the other components. Herein, the colored film is represented by 15' and the other components are represented by the same reference numerals. The colored film 15' comprises a silica film containing a cobalt pigment.

The colored film has a film transmittance of 58% in the central region (the range of a radius of about 100 mm around the center point) and a transmittance of 66% in the peripheral region except the above-mentioned region.

Now, description will be made about a method of manufacturing the colored film 15'.

First, the glass panel was arranged so that the outer surface thereof faces upward. A silica coating liquid containing a cobalt pigment with a film transmittance adjusted to 58% was applied by spray-coating onto the central region of the face portion. Subsequently, the silica coating liquid containing a cobalt pigment with a film transmittance adjusted to 66% was applied by spray-coating onto the peripheral region of the face portion of the glass panel. Thus, the colored film 15' was formed by coating on the entire area of the outer surface of the face portion of the glass panel 11.

Measurement was made of the transmittance of the glass panel with the colored film thus obtained. As a result, both of the central region and the peripheral region of the face portion had a transmittance of 46%. The cathode ray tube was produced by the use of the above-mentioned glass panel and the image thereon was observed. As a result, nonuniformity in brightness was not observed.

In Embodiment 2, description was made about the case where two kinds of the color coating liquids different in degree of light and dark were used. Alternatively, use may be made of three or more kinds of color coating liquids different in degree of light and dark to form a colored film which has three or more color tones of light and dark from the central region to the peripheral region of the face portion of the glass panel.

Comparative Example

Except that the color coating liquid was dropped onto the outer surface in the state where the entire area of the face portion of the glass panel was heated to a temperature of about 40° C., a glass panel having a colored film formed by coating was produced under the condition similar to that of the embodiment 1.

The colored film formed by coating on the outer surface of the glass panel had a uniform film thickness of 300 Å over the entire surface. Measurement of the transmittance thereof showed a value of 56% in the peripheral region of the face portion and a high value of 64% in the central region. The cathode ray tube was produced by the use of the above-mentioned glass panel and the image thereon was observed. As a result, nonuniformity in brightness was observed.

As the above-mentioned transmittance of the glass panel, use was made of the luminance mean transmittance measured by a spectrophotometer for a wavelength of 380 to 780 nm.

As described above, the cathode ray tube according to this invention uses the glass panel different in thickness between the central region and the peripheral region of the face portion. However, the difference in transmittance between the central region and the peripheral region of the face portion is reduced by provision of the colored film. Consequently, the difference in luminance between the central region and the peripheral region of the image is decreased so that nonuniformity in brightness is not caused to occur. The colored film also serves to improve the contrast.

In addition, the cathode ray tube of this invention comprises the colored film formed on the outer surface of the glass panel so that the increase in weight is extremely small and the excellent screen over a long period of time, in comparison with the case where a colored glass plate is used.

What is claimed is:

1. A cathode ray tube using a glass panel having a difference in thickness between a central region and a peripheral region of a face portion thereof, said glass panel having an outer surface with a colored film formed thereon, said colored film being thin in film thickness in an area corresponding to a thick part of said face portion of said glass panel and thick in film thickness in an area corresponding to a thin part of said face portion of said glass panel so as to reduce the difference in transmittance resulting from the difference in thickness between the central region and the peripheral region of said face portion of said glass panel.

2. A cathode ray tube as claimed in claim 1, characterized in that the radius of curvature of said face portion of said glass panel in a diagonal direction of the outer surface thereof is equal to 10000 mm or more.

3. A cathode ray tube as claimed in claim 1, characterized in that the formula of $1.2 \leqq TE/T_0 \leqq 4.0$ is satisfied where TE and $T_0$ represent the thickness of the peripheral region of said face portion of said glass panel in the diagonal direction and the thickness of the central region, respectively.

4. A cathode ray tube as claimed in claim 1, characterized in that said glass panel with said colored film formed on the outer surface has a difference in transmittance less than 5% between the central region and the peripheral region of said face portion thereof.

5. A cathode ray tube using a glass panel having a difference in thickness between a central region and a peripheral region of a face portion thereof, said glass panel having an outer surface with a colored film formed thereon, said colored film having a light color tone in an area corresponding to a thick part of said face portion of said glass panel and a dark color tone in an area corresponding to a thin part of said face portion of said glass panel so as to reduce the difference in transmittance resulting from the difference in thickness between the central region and the peripheral region of said face portion of said glass panel.

6. A cathode ray tube as claimed in claim 5, characterized in that the radius of curvature of said face portion of said glass panel in a diagonal direction of the outer surface thereof is equal to 10000 mm or more.

7. A cathode ray tube as claimed in claim 5, characterized in that the formula of $1.2 \leqq TE/T_0 \leqq 4.0$ is satisfied where TE and $T_0$ represent the thickness of the peripheral region of said face portion of said glass panel in the diagonal direction and the thickness of the central region, respectively.

8. A cathode ray tube as claimed in claim 5, characterized in that said glass panel with said colored film formed on the outer surface has a difference in transmittance less than 5% between the central region and the peripheral region of said face portion thereof.

* * * * *